United States Patent [19]

Zwald et al.

[11] Patent Number: 4,785,384

[45] Date of Patent: Nov. 15, 1988

[54] ELECTRIC SIMULATED GASLIGHT ASSEMBLY

[75] Inventors: John J. Zwald, Marblehead; John L. Hickey, Jr., Boston, both of Mass.

[73] Assignee: Gasglo, Incorporated, Marblehead, Mass.

[21] Appl. No.: 130,404

[22] Filed: Dec. 9, 1987

[51] Int. Cl.[4] ..... F21S 3/10

[52] U.S. Cl. ..... 302/255; 362/256; 362/260; 362/431; 431/125

[58] Field of Search ..... 313/110, 116, 117, 84; 362/810, 806, 255, 431, 256, 261, 262, 359, 392, 260; 315/58, 59

[56] References Cited

U.S. PATENT DOCUMENTS

| | | | |
|---|---|---|---|
| 3,148,839 | 9/1964 | Horelick | 362/255 |
| 4,173,730 | 11/1979 | Young et al. | 315/59 |
| 4,495,443 | 1/1985 | Cummings | 315/58 |
| 4,577,265 | 3/1986 | Krause, Jr. | 362/255 |
| 4,616,299 | 10/1986 | Krause, Jr. | 362/255 |
| 4,733,123 | 3/1988 | Zwald | 313/116 |

*Primary Examiner*—Ira S. Lazarus

*Assistant Examiner*—Sue Hagarman

*Attorney, Agent, or Firm*—Wolf, Greenfield & Sacks

[57] ABSTRACT

An electric lamp assembly simulating the appearance of a gaslight for installation in an existing incandescent-type light fixture. The assembly includes an adapter which contains a screw in, incandescent-type base projecting from one surface thereof, and a receptacle for receiving the base of a fluorescent lamp on an opposed surface thereof. The lamp is surrounded by a translucent cover, and a fabric mesh encloses the cover. A wire frame assembly is disposed on the outside of the cover and mesh. The cover includes longitudinally extending ridges which diffuse the light emanating from the lamp, to present an appearance that looks similar to a gaslight. Also, the cover may be provided with a tint which, in combination with the mantle, provides the light emanating from the lamp with a color virtually identical to the color of light which would emanate from a typical gaslight. Also phosphors may be provided in the fluorescent lamp which consist of blue-green phosphors, green-blue phosphors, and yellow phosphors in addition to or instead of the tinting on the cover to provide the desired color.

17 Claims, 3 Drawing Sheets

ELECTRIC SIMULATED GASLIGHT ASSEMBLY

FIELD OF THE INVENTION

This invention relates generally to electric lamp assemblies, and more particularly to arc discharge lamp assemblies which simulate a gaslight.

BACKGROUND OF THE INVENTION

Many people prefer the use of gaslights for illumination in exterior post lamps, entrance lights and street lamps because of their aesthetic appearance and because they create a street environment more typical of an earlier period of time. Gaslights are particularly preferred in portions of cities in which the architectural characteristics and ambiance of a particular period in history are desired to be maintained. However, gaslights have certain drawbacks, because they require the installation and maintenance of a supply of gas, which is not always practical, and because they cannot always be readily turned on and off. Also, the cost of installation and maintenance of a gaslight can be very high. For these reasons and because of the ready and cheap availability of electricity as a power source, electric lamps are commonly used in a manner to imitate gaslights. In the past, incandescent lamps have been employed in simulated gaslights. Examples of incandescent lamps used to simulate gaslights are found in U.S. Pat. Nos. 3,148,835; 4,577,265; and 4,616,299. However, such incandescent lamps have not proven to be satisfactory as a substitute for gaslights because even the best lamps do not closely resemble a gaslight either in intensity or in color. Furthermore, in some such incandescent lamps, the outline of the lamp or filament is visible.

Because of the increasing cost of electric energy, more energy efficient lamp types are often substituted for incandescent lamps. The most commonly used substitutes are fluorescent and high intensity discharge lamps. Both of such lamps have high luminous efficacies. One known type of compact fluorescent lamp includes two longitudinally extending leg members which are joined together by a transversely extending envelope portion. One example of such a commercially available lamp is the "twin-tube" fluorescent lamp manufactured by GTE Sylvania in Danvers, Mass., while another example of a commercially available lamp is the lamp sold as part of the MOD-U-LINE system by General Electric of Nela Park, Cleveland, Ohio. Even using fluorescent lamps, it is readily apparent on close observation that a light source is an electric lamp, as opposed to a gaslight. With some fluorescent lamps, the light output is non-uniform and the outline or silhouette of the bulb is visible. The color and intensity of the lamp also is distinguishable from that of a genuine gaslight. In lighting applications where the lamp envelope is clearly exposed, the light bears little resemblance to a gaslight. Examples of fluorescent lamps used for simulating gaslights are found in U.S. application Ser. Nos. 918,435; 918,444; and 918,459.

It is, therefore, an object of the present invention to provide an electric lamp which closely simulates the appearance of a gaslight.

It is another object of the present invention to provide a more energy efficient, fluorescent lamp which closely simulates the appearance of a gaslight.

It is still another of the present invention to provide an electric lamp assembly which generates light having generally the same color and intensity as light coming from a gaslight.

It is still another further object of the present invention to provide an electric lamp which simulates a gaslight and which can be installed in most conventional incandescent light fixtures.

SUMMARY OF THE INVENTION

This invention relates generally to an electric lamp assembly which accomplishes the foregoing objects by very closely simulating a gaslight. In one aspect of the invention a cover is provided surrounding the electric lamp, and a fabric mantle is stretched over the cover. In another aspect of the invention, a wire frame assembly is provided which resembles that of a gaslight. This assembly includes a first metal bracket which is wrapped about the plastic cover near its lower end and which captures the lower end of the mantle between the bracket and the outer surface of the cover. The assembly also includes a second metal bracket which surrounds the mantle near its top end and which captures the mantle between it and a projection extending from the top of the cover. The assembly also includes a unitary wire frame which passes through the projection on the top of the cover and which has two arms disposed on opposite sides of the cover.

In another feature of the invention, the cover is formed of a translucent material, such as plastic, and the cover has ridges on its sides to diffuse the light to enhance the gas simulation effect. In another aspect of the invention, the gas simulation effect is further enhanced either by tinting the cover a selected color, or by using appropriately colored phosphor coatings on the internal surface of a fluorescent lamp, or by using a combination of these two techniques.

In a preferred embodiment, the cover is affixed to an adapter, which has a screw in, incandescent-type base projecting from its lower surface which is adapted to mate with a threaded socket of an existing light fixture. The light source used is preferably a fluorescent lamp, although any other type of arc discharge lamp could be used. Typically, the cover is sealed to the adapter and surrounds the light source.

The electric simulated gaslight assembly of this invention more closely resembles a gaslight than most all prior art electric lamps. Furthermore, the assembly is adapted to be readily installed in any incandescent-type light fixture, and the assembly can be replaced just as one would replace any other lamp.

DESCRIPTION OF THE DRAWINGS

The objects, advantages and features of this invention will be more clearly appreciated from the following detailed description when taken in conjunction with the accompanying drawing in which.

DETAILED DESCRIPTION OF THE PREFERRED EMBODIMENTS

Figure 1:
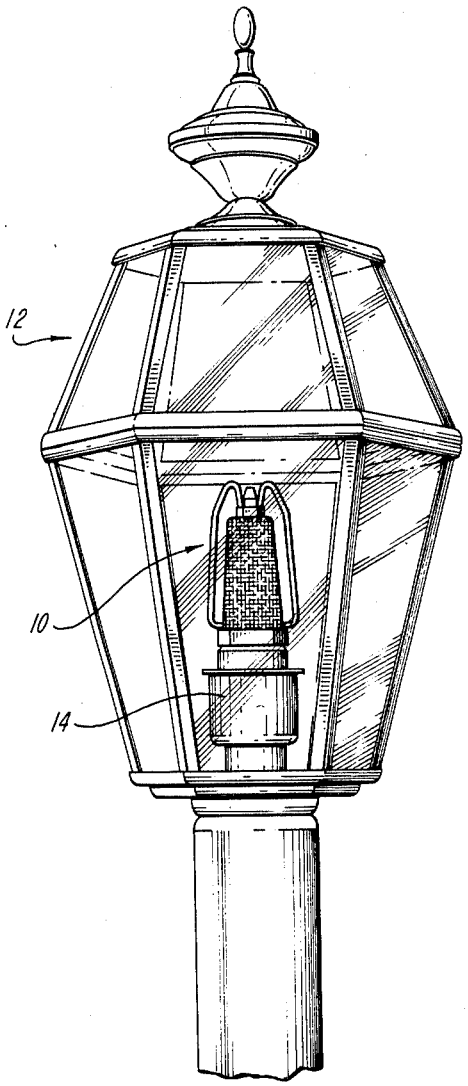
FIG. 1 is a pictorial representation showing the simulated gaslight assembly of this invention as used in an exemplary lantern.
Figure 2:
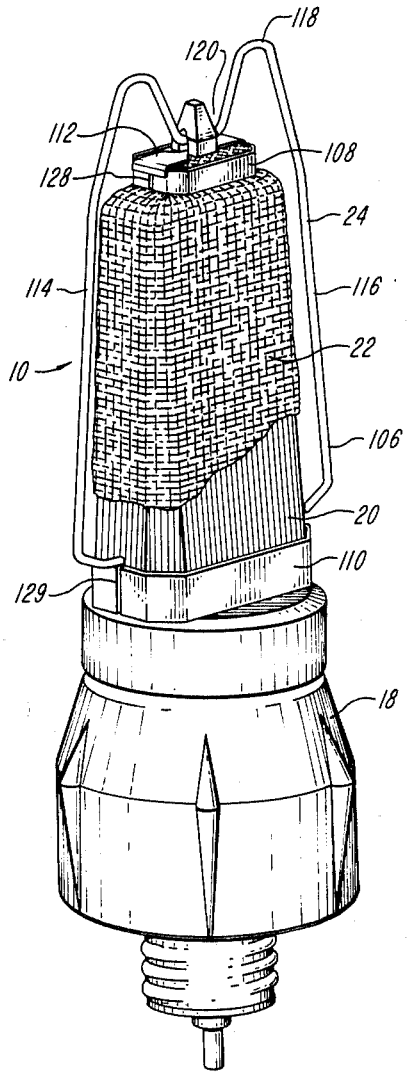
FIG. 2 is a perspective view of the simulated gaslight assembly of this invention.

With reference now to the drawings and more particularly to FIGS. 1 and 2 thereof, the electric simulated gaslight assembly 10 of this invention will be described. In FIG. 1, there is shown assembly 10 of this invention as incorporated into an exemplary lantern 12 which includes an incandescent light fixture 14. Assembly 10 as described herein is specifically adapted to be screwed into an existing light socket of an incandescent light fixture instead of a conventional incandescent electric light bulb. However, it is to be understood that assembly 10 can be modified to be used with other types of light fixtures consistent with the invention. Lantern 12 can be any commonly used lantern, such as a post lamp, a wall mounted lamp at an entry way, or any one of various types of hanging fixtures, chandeliers, and the like.

Figure 3:
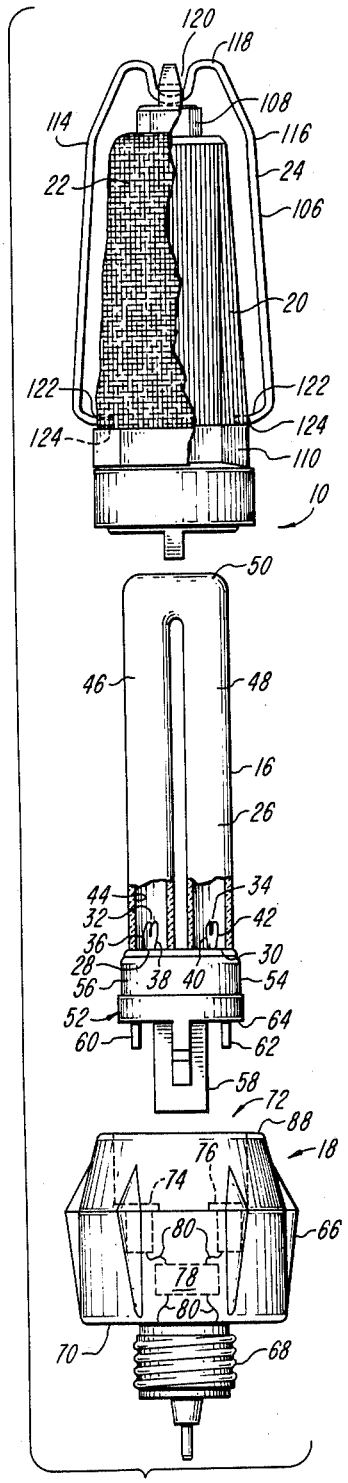
FIG. 3 is a partially cutaway, exploded view showing in schematic form the elements of the simulated gaslight assembly of FIG. 2.
Figure 4:
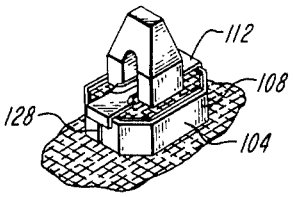
FIG. 4 is a partial top perspective view of the cover of the gaslight assembly of FIG. 2.
Figure 5:
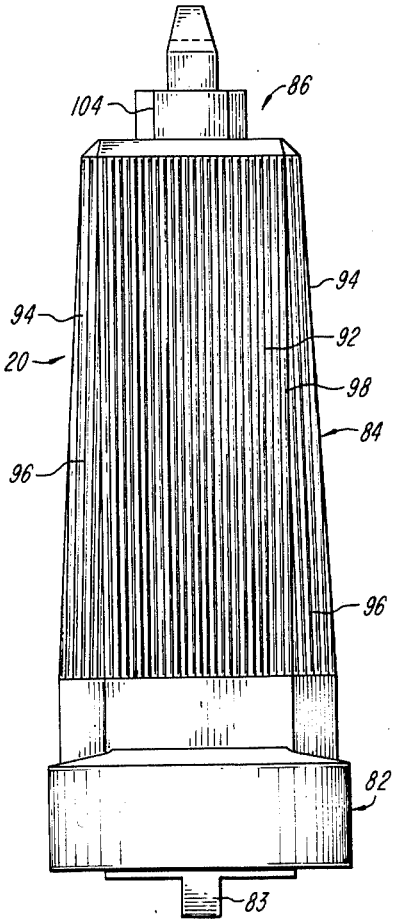
FIG. 5 is a front elevational view of the cover of the gaslight assembly of FIG. 2.
Figure 6:
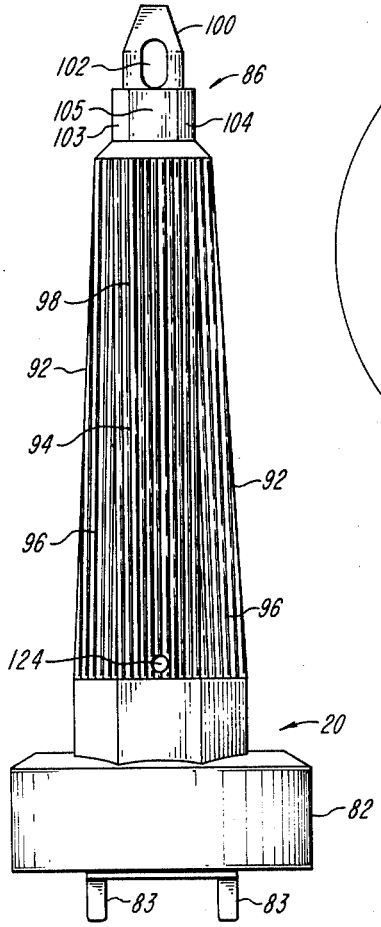
FIG. 6 is a side elevational view of the cover of the gaslight assembly of FIG. 2.

As shown in FIGS. 2 and 3, gaslight assembly 10 of the present invention includes an arc discharge lamp 16, an adapter 18, cover 20, mantle 22, and wire frame assembly 24.

As shown in FIG. 3, arc discharge lamp 16 typically is a fluorescent or high intensity discharge lamp. Lamp 16 comprises a sealed envelope 26 formed of a light-transmitting vitreous material, such as soda-lime or lead glass. Lamp 16 has a pair of end portions 28 and 30 and contains an ionizable medium including a quantity of mercury and an inert starting gas at low pressure such as, for example, on the order of 1–5 millimeters of mercury. The starting gas can be, for example, argon, crypton, neon or helium or a mixture of these and other gases. Electrodes 32 and 34 are supported by lead wires 36, 38 and 40, 42 respectively and are located within respective end portions 28 and 30 of envelope 26. Electrodes 32 and 34 can be, for example, double- or triple-coiled tungsten filaments of the usual type and typically carry a coating thereon which is in the form of alkaline earth oxides. The oxides are applied to the filaments in the form of carbonates which, upon processing, are converted into the oxides. A phosphor layer 44, which converts the ultraviolet radiation generated in the mercury discharge into visible radiation, is disposed on the internal surface of envelope 26.

Preferably, envelope 26 has at least two longitudinally extending leg members 46 and 48 which are joined together by a transversely extending envelope portion 50. Leg members 46 and 48 are spaced a predetermined distance apart, such as about 2 millimeters. Suitable, commercially available arc discharge lamps are sold by General Electric Company of Nela Park, Cleveland, Ohio 44112, as part of its MOD-U-LINE system, and by GTE Sylvania of Danvers, Mass., under its "twin-tube" designation. Alternatively, envelope 26 of lamp 16 may comprise a plurality of leg members, such as four, disposed in a substantially quadrangular or quadralinear columnar array and joined together by a plurality of transversely extending envelope portions to form a single elongated discharge path. In this alternative embodiment, each of the leg members is spaced a predetermined distance apart from adjacent leg members. The distances between adjacent leg members may be equal or they may vary.

As shown in FIG. 3, end portions 28 and 30 may be located adjacent one another and connected to suitable lamp base 52. Base 52 includes a generally oval-shaped upper portion 54 having an external surface 56 and a lower portion 58. A conventional starter (not shown) including a conventional glow bar with a radio interference capacitor is located within lower portion 58 and is electrically connected to lead wires 36 and 40. A pair of contacts 60 and 62 project from a surface 64 of lamp base 52 and are electrically connected to lead wires 38 and 42, respectively.

Adapter 18, as best shown in FIG. 3, includes a housing 66 of an electrically insulating material having a screw in, incandescent type base 68 projecting from one surface 70 of housing 66 for mating with a threaded socket of an existing light fixture. A pair of contact receiving means 72, for example, sockets 74 and 76 is located on another surface of housing 66 for respective mating with lamp contacts 60 and 62 which project from surface 64 of lamp base 52. Ballast means 78, including a conventional choke coil or electronic ballasting circuit, are contained within housing 66 of adapter 18 and, together with the necessary electrical wiring 80, electrically connect incandescent type base 68 to sockets 74 and 76. A suitable, commercially available adapter is sold by General Electric Company of Nela Park, Cleveland, Ohio, as part of its MOD-U-LINE system. Adapter 18 is typically generally circular in shape in cross-section.

Cover 20 will now be described with particular reference to FIGS. 4–8. Cover 20 provides shape and form to mantle 22 as well as other functions as described below, to render assembly 10 as similar as possible to a gaslight. Cover 20 includes a base portion 82, intermediate portion 84, and upper projection 86. Base portion 82 generally conforms to the cross-sectional shape of adapter 18. Since adapter 18 is typically circular in cross section at upper surface 88, base 82 is also preferably circular in cross section. Base portion 82 includes a pair of downwardly depending projections 83 which facilitate fixation of cover 20 to surface 88 of adapter 18. Preferably, base 82 is glued or otherwise permanently affixed to upper surface 88 to seal lamp 16 therein, although cover 20 could be removably affixed to adapter 18, such as by screw threads or by a snap fit. Sealing cover 20 to adapter 18 creates an insulating layer of air around lamp 16 and protects lamp 16 from moisture.

Intermediate portion 84 extends upwardly from base portion 82, and typically tapers slightly from base portion 82 to projection 86. Portion 84 must be sufficiently large to completely enclose lamp 16, but must not be so large as to be unwieldy or aesthetically unpleasing. Portion 84 includes two opposed, broad, generally planar faces 92, and two opposed narrow, generally planar faces 94. Preferably, faces 94 are joined to faces 92 by beveled surfaces 96 to render the cross-sectional configuration of portion 84 of cover 20 rounded and thus more aesthetically pleasing.

Figure 7:
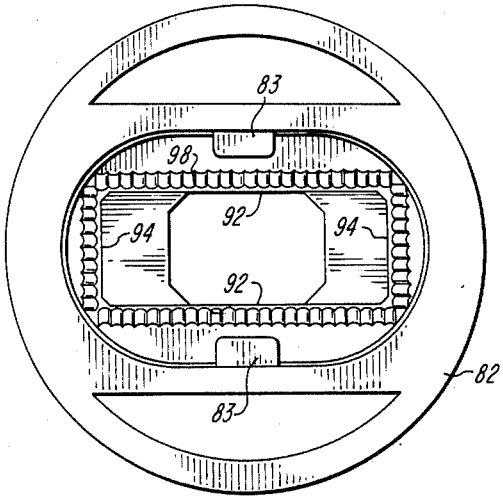
FIG. 7 is a bottom elevational view of the cover of the gaslight assembly of FIG. 2.
Figure 8:
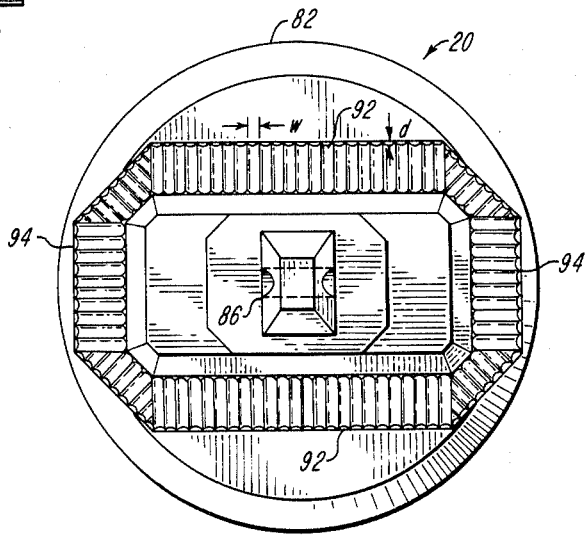
FIG. 8 is a top elevational view of the cover of the gaslight assembly of FIG. 2.

Broad faces 92, narrow faces 94, and beveled surfaces 96 each are provided with longitudinally extending ridges 98 which run from base 82 to projection 86. Ridges 98 preferably are closely spaced and parallel and are disposed on the outer surfaces of faces 92 and 94 and surfaces 96. Ridges 98 can also be provided on the inner surfaces of faces 92 and 94 and of surfaces 96 as shown in FIG. 7. In a preferred embodiment, ridges 98 typically have a scallop-type configuration, and are spaced approximately 0.04 inches apart as shown by the dimension "W" in FIG. 8. Ridges 98 typically have a depth "d" of approximately 0.13 inches. The provision of such ridges 98 enhances the gas simulative effect of assembly 10 by diffusing the light emanating from lamp 16 along the entire length and width of lamp 16. Also, the fact that faces 92 and 94 are spaced from lamp 16 further assists in diffusing light from the lamp. When cover 20 is used with mantle 22, the shape and configuration of lamp 16 is not visible. The result is a more uniform emission of light from cover 20 which is more typical of a gaslight. Also, with ridges 98, cover 20 tends to diffuse heat more effectively than would cover 20 if it had no ridges.

Cover 20 surrounds lamp 16 completely. Therefore, cover 20 must be translucent to allow light to escape from lamp 16 and to be visible. However, cover 20 should not be totally transparent, because lamp 16 would be visible, and cover 20 cannot be opaque for obvious reasons. It has found that a preferred material for forming cover 20 is a molded plastic, such as a polycarbonate. A commercially available, suitable material is sold under the trademark LEXAN. Another suitable, commercially available material is sold under the trademark MOBAY M-39.

The color or hue of a gaslight can be closely approximated, when cover 20 is used with mantle 22, by tinting cover 20 with an appropriate color. It has been found that a tint which includes yellow and blue pigments and titanium provides light emitted from lamp 16 and through mantle 22 with a color which simulates the color emitted by a conventional gaslight. A preferred formulation is C-P-C-05850 as sold commercially by Reed Plastic Corp. of Holden, Mass., which produces a bluish-green color in the cover. As a result of ridges 98, and the tint provided to cover 20, the resultant light very closely approximates that emitted by a gaslight in color, uniformity and intensity.

The color or hue of a gaslight also can be closely approximated by selecting appropriately colored phosphors for phosphor layer 44 of envelope 26. It has been found that various combinations of yellow and blue-green phosphors can be used to provide the light emitted from lamp 16 with the desired color. The following three phosphors, all commercially available from GTE Sylvania, can be used either alone, or in combination with others of the three phosphors to produce the desired color for the light: Sylvania 242, a green-blue phosphor with a nanometer rating of 494; Sylvania 245, a blue-green phosphor with a nanometer rating of 509; and Sylvania 250, a yellow phosphor with a nanometer rating of 578.

In an alternative embodiment, the desired color can be produced both by tinting cover 20 and by selecting appropriate colored phosphors from the above three selections for use on phosphor layer 44. By adjusting the tint on cover 20 and the relative concentrations of the above-identified three phosphors used in layer 44, the desired color for the light can be achieved.

It has been found that the desired intensity of light which most closely simulates the intensity of a gaslight is emitted by a 7 watt lamp 16. However, commercially available 7 watt lamps 16 tend to have a height greater than that of a typical gaslight, and cover 20 must be provided with a height sufficient to accommodate that of lamp 16. To closely simulate the appearance of a gaslight, faces 92 and 94 are provided with the approximate dimensions of a gaslight, and the remaining space necessary to accommodate lamp 16 is incorporated into base portion 82, which must be rendered opaque. Base portion 82 may be rendered opaque in the manufacturing process, or it may be treated subsequent to formation with a paint, such as a black paint, which has a color which is the same as the exterior color of adapter 18. In this way, base portion 82 is not visible and no light passes therethrough, and base portion 82 appears to form a part of the base of the gaslight.

Projection 86 extends from the top of cover 20, and typically is molded as a unitary part of cover 20. Projection 86 includes an upper portion 100 which contains an aperture 102 for use in conjunction with wire frame assembly 24, as will be described, and a lower portion 104 which is generally rectangular in cross section with beveled edges 103 joining generally planar, opposed faces 105.

Mantle 22 will now be described with particular reference to FIGS. 2 and 3. Mantle 22 is a mesh fabric which surrounds cover 20. Mantle 22 covers all of faces 92 and faces 94, but typically does not cover base portion 82. Mantle 22 extends up to and surrounds lower portion 104 of projection 86. Mantle 22 can comprise any suitable cloth material which is formed with a loose woven or knitted mesh and that resembles a gaslight mantle, such as, for example, cotton, silk, or a plastic material. Mantle 22 need not be fire resistant. In a preferred embodiment, mantle 22 is formed of a material having a color which ranges from off-white to yellow. A preferred color is that of natural nylon, and a preferred material is natural nylon, such as a DuPont 185 nylon. Preferably, this nylon is 400 denier. However, other cloth materials having other deniers can be used with good effect. The preferred embodiment for mantle 22 provides an aesthetic appearance typical of authentic gaslights.

Wire frame assembly 24 will now be described with particular reference to FIGS. 2 and 3. Wire frame assembly 24 includes a wire frame 106, upper bracket 108, lower bracket 110, and retainer 112. Wire frame 106 includes two legs 114 and 116 joined together by an inverted W-shaped connecting portion 118. Center portion 120 of connecting portion 118 passes through aperture 102 of projection 86. Each of legs 114 and 116 extends from connecting portion 118 downwardly along and adjacent to a corresponding face 94 to a point above base portion 82. Angled end 122 on each of legs 114 and 116 extends into a hole 124 provided in each corresponding face 94 just above the location of lower bracket 110. Wire frame 106 is typically formed of a resilient material, such as metal, which has been preformed so that ends 122 are retained in holes 124 by the spring effect of legs 114 and 116. Brass or brass plated steel are preferred materials for forming the elements of wire frame assembly 24.

Disposed between holes 124 and base portion 82 and wrapped about faces 92 and 94 is lower bracket 110. Typically, the portion of faces 92 and 94 enclosed by bracket 110 does not have ridges 98. Lower bracket 110 serves as a clamp to capture the lower end of mantle 22 between it and faces 92 and 94 of cover 20 to hold mantle 22 in place. Bracket 110 is formed of a strong, resilient material, such as a metal, which has been preformed into a size and shape to conform to faces 92 and 94 of cover 20. Bracket 110 has a split 129 to facilitate insertion of bracket 110 on cover 20. Angled ends 122 prevent bracket 110 from riding up on cover 20.

The upper end of mantle 22 is held in place by upper bracket 108 which acts as a clamp to capture the upper end of mantle 22 between itself and lower portion 104 of projection 86. Again, upper band 108 is formed of a strong, resilient material, such as a metal, which has been preformed to conform to the size and shape of lower portion 104 and which is wrapped tightly about lower portion 104. Upper bracket 108 has a split 128 which facilities the insertion of bracket 108 on projection 86. Upper bracket 108 is held in place by retainer 112 which passes through aperture 102 in projection 86 and grasps the upper edge of upper bracket 108 at two opposed points thereon. Center portion 120 sits on retainer 112 where it passes through aperture 102 to prevent retainer 112 from popping off upper band 108. Typically, retainer 112 grasps upper bracket 108 at split 128 to help retain split 128 together. Upper bracket 108 and lower bracket 110 together keep mantle 22 tightly stretched on cover 20 to prevent any wrinkles from forming. In addition, in combination with mantle 22, wire frame assembly 24 provides the aesthetic appearance of a true gaslight. It is not anticipated that wire frame assembly 24 would be removed from cover 20 during normal use.

In use, assembly 10 is provided as a unitary assembly with lamp 16 already installed, and with cover 20 fixedly secured to adapter 18. However, it is to be understood that cover 20 could be removable, such as by the provision of threads. Mantle 22 is provided tightly secured about cover 20, as previously described, with wire frame assembly 24 holding it in place. Assembly 10 can be screwed into any conventional incandescent-type light socket and can be utilized in place of any conventional incandescent-type lamp.

Assembly 10 of this invention provides a superior simulation of a gaslight. These superior characteristics are provided in part by ridges 98 on faces 92 and 94 of cover 20 which diffuse the light from lamp 16 to provide a uniform illumination and, which, in combination with mantle 22, prevents the shape of lamp 16 from being visible. The particular tinting used with cover 20 and/or the phosphors used for layer 44, in combination with the light naturally emitted from lamp 16, and the color of mantle 22, produce a color which closely approximates that emitted by a genuine gaslight. The use of mantle 22 and wire frame assembly 24 closely simulates the appearance of a gaslight, but they serve primarily a decorative function, and prevent cover 20 from being visible externally of assembly 10.

For purposes of illustration, certain dimensions of assembly 10 are set forth below. However, it is to be understood that the following illustrative dimensions in no way limit the scope of the invention. Typically, cover 20 has a height of about 4.5 inches. With upper portion 100 has a height of approximately 0.4 inches, and lower portion 104 has a height of approximately 0.64 inches. Ridges 98 extend along faces 92 and 94 a distance of approximately 3¾ inches. Surfaces 96 form angles of approximately 45° with respect to faces 92 and 94, and the wall thickness of cover 20 is approximately 0.06 inches.

The above description is exemplary, and modifications and improvements are intended to fall within the scope of this invention as defined solely by the following claims and their equivalents.

What is claimed is:

1. An electric lamp assembly for simulating a gaslight comprising:

an electric lamp having a base;

an insulated adapter having a socket on one side for receiving said base of said electric lamp and a conductive base projecting from another side of said adapter, said one side having an upper surface adjacent said socket;

a cover translucent to visible light secured to said upper surface of said adapter and surrounding said lamp; and a fabric mantle substantially surrounding portions of said cover.

2. An electric lamp assembly as recited in claim 1 wherein said cover comprises a plurality of closely spaced ridges for diffusing light emanating from said lamp.

3. An electric lamp assembly as recited in claim 1 wherein said cover comprises:

a base portion secured to said upper surface of said adapter;

lateral faces surrounding said lamp and extending from said base portion outwardly away from said adapter; and an upper projection disposed on an end of said cover spaced from said adapter, said projection having an aperture extending therethrough.

4. An electric lamp assembly as recited in claim 3 wherein said lateral faces contain a plurality of closely spaced ridges.

5. An electric lamp assembly as recited in claim 3 further comprising a wire frame assembly which comprises:

a pair of spaced legs, said legs being disposed on opposite sides of said cover adjacent corresponding lateral faces thereof; and an upper connecting portion extending between said two legs, said upper connecting portion passing through said aperture in said upper projection on said cover.

6. An electric lamp assembly as recited in claim 5 wherein each of said pair of legs has an end which is inserted into a cooperatively formed hole disposed on one of said lateral faces of said cover adjacent to but spaced from said base portion of said cover.

7. An electric lamp assembly as recited in claim 5 wherein said upper connecting portion has a generally inverted W-shape.

8. An electric lamp assembly as recited in claim 1 further comprising:

an upper bracket for clamping an upper end of said mantle to said projection on said cover; and a lower bracket for clamping a lower end of said mantle to said cover adjacent said base thereof.

9. An electric lamp assembly as recited in claim 1 wherein said cover is tinted with yellow and blue pigments.

10. An electric lamp assembly as recited in claim 1 wherein said electric lamp is an arc discharge lamp.

11. An electric lamp assembly as recited in claim 10 wherein said arc-discharge lamp comprises a fluorescent lamp.

12. An electric lamp assembly as recited in claim 11 wherein said fluorescent lamp comprises a phosphor layer disposed on an internal surface of a lamp envelope and wherein said phosphor layer comprises phosphors selected from the group consisting of blue-green phosphors, green-blue phosphors, and yellow phosphors.

13. An electric lamp assembly as recited in claim 11 wherein said lamp comprises:

a sealed envelope of light transmitting vitreous material;

a pair of end portions formed on said envelope;

at least two longitudinally extending leg portions, said leg portions being spaced a predetermined distance apart and being generally parallel to one another, said leg portions being joined together by a transversely extending envelope portion;

an ionizable medium contained within said envelope;

an electrode disposed within each of said end portions; and a phosphor layer disposed on the internal surface of said envelope.

14. A lamp assembly as recited in claim 13 wherein said phosphor layer comprises phosphors selected from the group consisting of green-blue phosphors, blue-green phosphors, and yellow phosphors.

15. An electric lamp assembly as recited in claim 1 wherein said mantle is formed of a fabric having a natural nylon color.

16. A lamp assembly as recited in claim 1 wherein said conductive base of said adapter is threaded and is adapted for threading into an incandescent-type light socket.

17. An electric lamp assembly for simulating a gaslight comprising:

an insulated adapter having a receptacle on an upper surface thereof;

a threaded conductive member extending from a lower surface of said adapter which is adapted to be screwed into an incandescent-type socket in a light fixture;

an arc discharge lamp inserted into said receptable on said upper surface of said adapter and being electrically coupled to said conductive member, said lamp having a phosphor layer disposed on an internal surface thereof, said phosphor layer comprising phosphors selected from the group consisting of blue-green phosphors, green-blue phosphors, and yellow phosphors;

a translucent, tinted cover surrounding said lamp, said cover having a plurality of closely spaced ridges disposed on lateral surfaces thereof;

a fabric mantle generally surrounding said lateral surfaces of said cover; and a wire frame assembly mounted on said cover.

* * * * *